US006522216B2

(12) United States Patent
Makino et al.

(10) Patent No.: US 6,522,216 B2
(45) Date of Patent: Feb. 18, 2003

(54) NONRECIPROCAL CIRCUIT DEVICE AND COMMUNICATION APPARATUS

(75) Inventors: Toshihiro Makino, Matto (JP); Seigo Hino, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/900,088

(22) Filed: Jul. 6, 2001

(65) Prior Publication Data

US 2002/0014927 A1 Feb. 7, 2002

(30) Foreign Application Priority Data

Jul. 7, 2000 (JP) ..... 2000-206122

(51) Int. Cl.[7] ..... H01P 1/32
(52) U.S. Cl. ..... 333/24.2; 333/1.1
(58) Field of Search ..... 333/1.1, 24.2

(56) References Cited

U.S. PATENT DOCUMENTS 4,016,510 A * 4/1977 Hodges, III et al. ..... 333/1.1
6,121,851 A * 9/2000 Takane et al. ..... 333/1.1
6,222,425 B1 * 4/2001 Okada et al. ..... 333/1.1
6,366,178 B1 * 4/2002 Makino et al. ..... 333/1.1

FOREIGN PATENT DOCUMENTS

| | | | |
|---|---|---|---|
| EP | 1 139 486 | 10/2001 | |
| GB | 2 266 412 | 4/1993 | |
| JP | 04-172702 | * 6/1992 | ..... H01P/1/383 |
| JP | 9-116308 | 6/1997 | |

* cited by examiner

*Primary Examiner*—Michael Tokar
*Assistant Examiner*—Vibol Tan
(74) *Attorney, Agent, or Firm*—Keating & Bennett, LLP

(57) ABSTRACT

The present invention provides a nonreciprocal circuit device which has solved problems, such as the increase in production cost, the reduction in reliability, and the overall upsizing thereof, which are caused by the mounting of a circuit element having a matching circuit onto a printed board, and also provides a communication apparatus including this nonreciprocal circuit. This nonreciprocal circuit includes a ferrite assembly formed by combining mutually intersecting first and second central conductors and a ferrite, magnets applying an magnetostatic field to this ferrite assembly, and a yoke. Furthermore, circuit elements which are connected to the first and second central conductors and which constitute a matching circuit, are formed in a dielectric laminated substrate, on which the ferrite assembly is mounted.

9 Claims, 5 Drawing Sheets

NONRECIPROCAL CIRCUIT DEVICE AND COMMUNICATION APPARATUS

BACKGROUND OF THE INVENTION

1. Field of the Invention

The present invention relates to a nonreciprocal circuit device, such as an isolator, used in a microwave band, or the like and to a communication apparatus including this isolator.

2. Description of the Related Art

A conventional two-port type nonreciprocal circuit device has been constructed by discretely preparing circuit elements such as capacitors and resistors, and disposing them at predetermined positions on a printed board, installing them, and disposing, on the printed board, a ferrite assembly which comprises a ferrite and two central conductors arranged on the ferrite so as to intersect each other.

The above-described capacitor has been constructed by forming electrodes on both surfaces of a dielectric substrate, and then cutting out the electrodes into a predetermined size. As a resistance element, an ordinary chip resistor has been used.

In conventional two-port type nonreciprocal circuit device, correctly disposing circuit elements at predetermined positions on a printed board and installing them, requires numerous processes and a great deal of man-hours, and makes mass-production at a low cost difficult. In addition, since it is necessary to vary the capacity value of each of required capacitors in accordance with the operating frequency or the application of a nonreciprocal circuit device, the variety of cut-out sizes of dielectric substrate increases, so that the management of capacitor elements becomes complicated. Furthermore, since numerous circuit elements are installed, connection points increases, resulting in a reduced reliability. Moreover, since it is necessary to provide the area needed to dispose these circuit elements on the printed board, the printed circuit is difficult to reduce its size. This makes it difficult to meet the market demand for miniaturization of the nonreciprocal circuit device.

SUMMARY OF THE INVENTION

Accordingly, it is an object of the present invention to solve the above-described problems by eliminating the need to mount the above-described circuit elements onto a printed board, and to provide a nonreciprocal circuit device which allows mass production thereof at a low cost, which eliminates complicatedness of the management of capacitor elements, which facilitates the securing of reliability by reducing connection points, and which allows an reduction in the overall size thereof by the reduction in the area of a substrate.

The invention provides a nonreciprocal circuit device, comprising a ferrite assembly consituted by combining a ferrite and first and second central conductors which are arranged so as to mutually intersect in a state of being electrically insulated from each other, a magnet applying an magnetostatic field to the ferrite assembly, a yoke, and circuit elements which are connected to the first and second central conductors and which constitute a matching circuit. In this nonreciprocal circuit device, the circuit elements are constituted of a dielectric body of a dielectric laminated substrate on which said ferrite assembly is mounted, and electrodes provided on predetermined layers of the dielectric laminated substrate.

Thus forming circuit elements constituting a matching circuit in the substrate on which the ferrite assembly is mounted, solves the above-described problems involving in mounting discrete chip-shaped capacitors and chip resistors onto a printed board.

In the nonreciprocal circuit board in accordance with the present invention, preferably, a plurality of capacitors is formed within the dielectric laminated substrate. Particularly in a two-port type nonreciprocal circuit device, by incorporating numerous capacitors required for a matching circuit into a single dielectric laminated substrate, the mass-productivity is increased, the complicatedness of the management of capacitor elements is eliminated, the reliability is improved, and thereby the effects of overall size-reduction and cost-reduction are enhanced.

Also, in the present invention, preferably, the dielectric laminated substrate has a recess or a hole at which the ferrite portion of the ferrite assembly is engaged with the dielectric laminated substrate. This facilitates the fixing of the ferrite assembly to within the nonreciprocal circuit device, eliminates the need for special members for fixing, and reduces the overall height by the dimension of the ferrite portion engaged into the above-described recess or hole.

Furthermore, in the present invention, it is preferable that the ferrite assembly be formed by winding each of the central conductors around the ferrite, and that the dielectric laminated substrate have a recess or a hole at which the central conductor portion of the ferrite assembly is engaged into the dielectric laminated substrate. Thereby, the fixing of the ferrite assembly to within the nonreciprocal circuit device is facilitated, and the overall height of the nonreciprocal circuit device is reduced by the dimension of the central conductor portion engaged into the above-described recess or hole.

Moreover, in the present invention, it is preferable that the ferrite assembly, the magnet, and the yoke be arranged on the dielectric laminated substrate in this order, that through hole electrodes be provided in the side surfaces of the dielectric laminated substrate, and that projections provided on the yoke are engaged into the through hole electrodes. This arrangement facilitates the ground connection of the dielectric laminated substrate and yoke, and prevents the connection portions from projecting outside from the side surfaces of the dielectric laminated substrate.

Also, in the present invention, preferably, the projections of the yoke and the through hole electrodes are soldered together, whereby electric and mechanical coupling are simultaneously achieved.

Furthermore, in the present invention, preferably, electrodes to be connected to the central conductors are provided on the top surface of the dielectric laminated substrate. Thereby, the central conductors of the ferrite assembly can be easily surface-mounted on the top surface of the dielectric laminated substrate.

In addition, in the present invention, preferably, electrodes to be connected to external circuits are provided on the bottom surface of the dielectric laminated substrate. This allows these electrodes to be used as terminals when the nonreciprocal circuit device is surface-mounted onto the circuit board on which it is to be mounted.

Moreover, the present invention provides a communication apparatus which uses a nonreciprocal circuit device comprising any one of the above-described constructions, and which is provided in, for example, the output section of the circuit for amplifying transmitted signals.

The above and other objects, features, and advantages of the present invention will be clear from the following detailed description of the preferred embodiments of the invention in conjunction with the accompanying drawings.

DESCRIPTION OF THE PREFERRED EMBODIMENTS

The construction of an isolator in accordance with a first embodiment will be described with reference to FIGS. 1 to 3.

Figure 1:
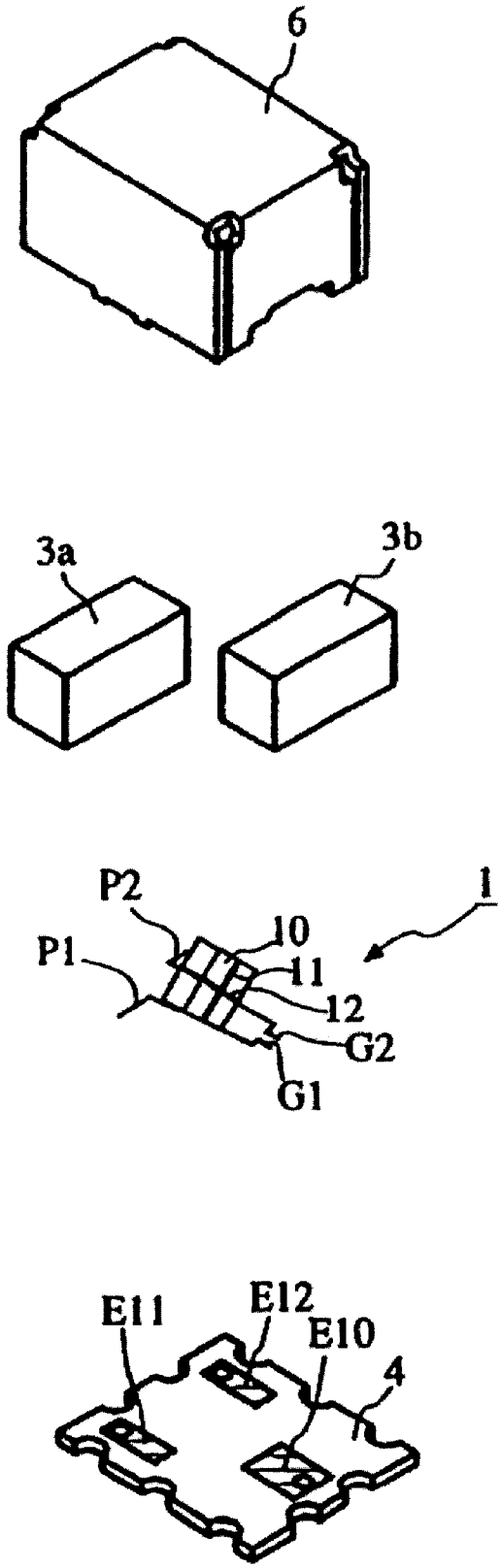
FIG. 1 is an exploded perspective view showing an isolator in accordance with a first embodiment of the present invention.

FIG. 1 is an exploded perspective view showing this isolator. Here, reference numeral 1 denotes a ferrite assembly which is formed by winding a first central conductor 11 and a second central conductor 12 around a ferrite 10, the first and second central conductor 11 and 12 each being formed of an insulation-coated wire.

Reference numerals 3*a* and 3*b* each denote permanent magnets which apply a magnetostatic field to the ferrite 10, and numeral 6 denotes a yoke which constitutes a magnetic circuit, and which doubles as a case. Numeral 4 denotes a dielectric laminated substrate, which has electrodes E10, E11, and E12 formed on the top surface the dielectric laminated substrate 4, for connecting the central conductors of the ferrite assembly 1 to the dielectric laminated substrate. The one-side end portions P1 and P2 of the first and second central conductors 11 and 12 of the ferrite assembly 1 are connected to the electrodes E11 and E12, respectively, and each of the other end portions G1 and G2 is connected to the electrode E10.

Figure 2A:
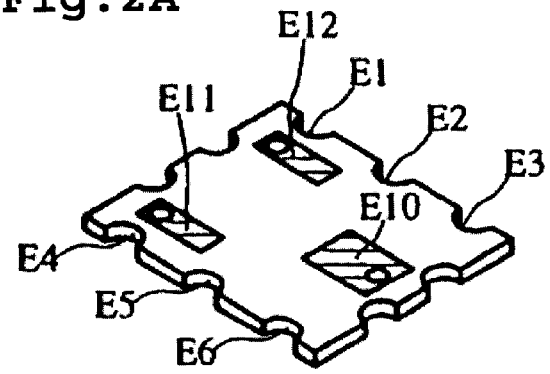
FIGS. 2A to 2D are perspective views illustrating the structure of the dielectric laminated substrate of the isolator shown in FIG. 1.
Figure 2C:
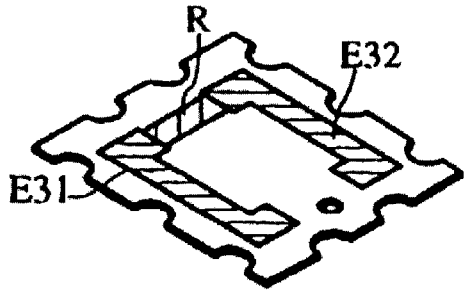
Figure 2B:
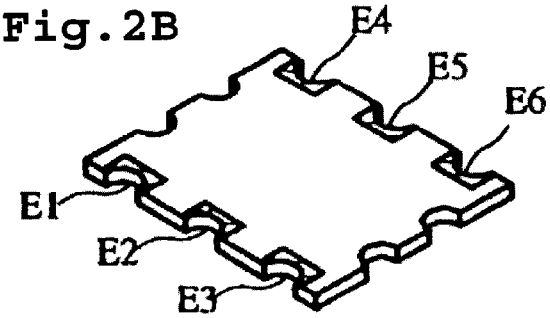
Figure 2D:
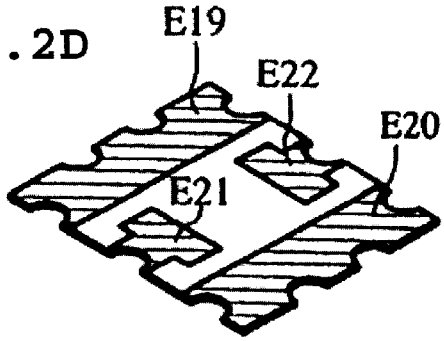

FIGS. 2A to 2D are perspective views showing the structure of the above-described dielectric laminated substrate 4. FIG. 2A is a perspective view of the dielectric laminated substrate at its entirety, and FIG. 2B is a perspective view of the dielectric laminated substrate when turned upside down. This dielectric laminated substrate is a dielectric ceramic multilayer substrate constituted of three dielectric layers and four electrode layers. FIG. 2C is a perspective view showing the top surface of the intermediate dielectric layer, and FIG. 2D is a perspective view showing the top surface of the bottom dielectric layer.

The electrostatic capacitances generated between the electrodes E21 and E22 shown in FIG. 2D, and the respective electrodes E31 and E32 shown in FIG. 2C are used as capacitors. Also, the electrostatic capacitances generated between electrodes E19 and E20 shown in FIG. 2D, and the respective electrodes E31 and E32 shown in FIG. 2C are used as capacitors. A resistor film indicated by reference character R is formed as a resistor, between one-side ends of the electrodes E31 and E32. Electrodes E11 and E12 on the surface, shown in FIG. 2A are conductively connected to the electrodes E31 and E32 shown in FIG. 2C, respectively, via through holes. E10 and E20 are also conductively connected to each other via a through hole. Electrodes E19 and E20 are conductively connected to terminal electrodes E1 and E4, and terminal electrodes E3 and E6 on the bottom surface of the substrate, respectively, via end faces of the substrate. Also, electrodes E21 and E22 are conductively connected to terminal electrodes E5 and E2, respectively, from end faces to the bottom surface of the substrate.

Figure 3:
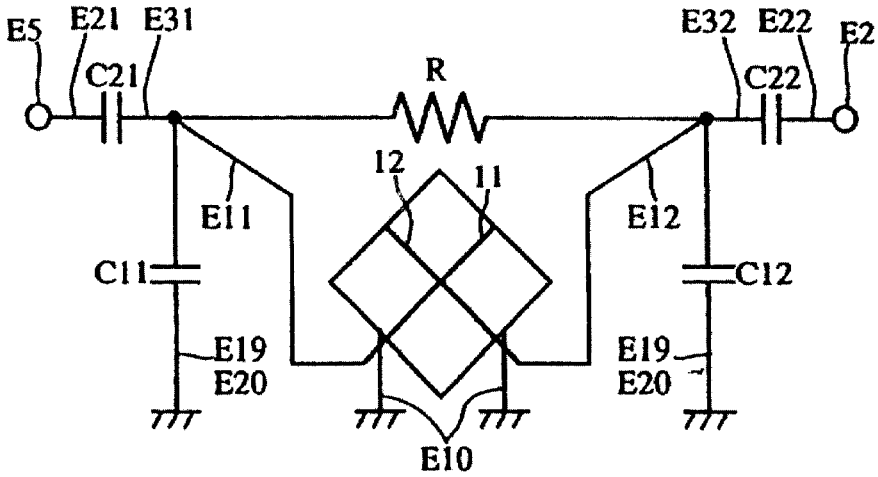
FIG. 3 is an equivalent circuit diagram of the isolator shown in FIG. 1.

FIG. 3 is a circuit diagram of the above-described isolator.

One end of each of the central conductors 11 and 12 is grounded. A capacitor C21 is connected in series between the other end of the central conductor 11 and an input terminal. A capacitors C22 is connected in series between the other end of the central conductor 12 and an output terminal. Also, a capacitor Cl is connected in parallel with the central conductor 11 between the other end of the central conductor 11 and the ground. A capacitors C12 is connected in parallel with the central conductor 12 between the other end of the central conductor 12 and the ground. In addition, a resistor R is connected across the other ends of the central conductors 11 and 12.

Given a transmission of a signal in the forward direction, both ends of the resistor R will exhibit the same phase and the same amplitude, and no current will flow through the resistor R, with the result that an input signal from the input terminal will be outputted from the output terminal just as it is.

On the other hand, given an incidence of a signal in the reverse direction, the direction of a high-frequency magnetic field passing through the ferrite 10 becomes opposite to that in the case of the above-mentioned forward transmission, and consequently signals of mutually opposite phases occur at both ends of the resistor R, and power is consumed at the resistor R. As a result, ideally, no signal is outputted from the input terminal. In reality, however, the phase difference between the both ends of the above-described resistor varies between when a signal is transmitted in the forward direction and when a signal is made incident in the reverse direction, in accordance with the crossing angle between the central conductors 11 and 12 and the rotational angle of the polarized wave surface by Faraday rotation. Therefore, the strength of a magnetostatic field to be applied to the ferrite 10 and the crossing angle between the central conductors 11 and 12 are set so as to reduce the insertion loss and to achieve high nonreciprocal (isolation) characteristics.

The above-described operation is based on the premise that a matching has been achieved between the input/output impedance and the impedance of the isolator. However, when the ferrite 10 is reduced in the size, the length of the central conductors thereof 11 and 12 are reduced, and the inductance component correspondingly decreases. As a result, when operating the isolator at a desired frequency, an impedance matching cannot be achieved.

Accordingly, the central conductors 11 and 12 are wound around the ferrite 10, and thereby the inductance of the central conductors is increased even though a small ferrite plate is used. However, since the increase in inductance of the central conductors due to the winding of the central conductors is steep, there occurs cases where the impedance of the isolator becomes higher than the input/output impedance (typically 50 Ω), so that no impedance matching is achieved only by using the capacitors 11 and 12 which are connected in parallel with each other across the input/output terminals. Accordingly, capacitors C21 and C22 each having a predetermined capacity are connected in series with the input/output terminals.

As the above-described central conductors 11 and 12, copper wires each having insulation-coated surface are used. As a material for insulation coating, polyimide, polyamidoimide, polyesterimide, polyester, polyurethane, or the like are employed. The diameter of this copper wire is set to 0.1 mm or below.

In the example shown above, copper wires have been taken as an example of central conductors, but metallic wires formed of another metal such as silver, gold, or an alloy including any one of them, may be used as central conductors.

Figure 4A:
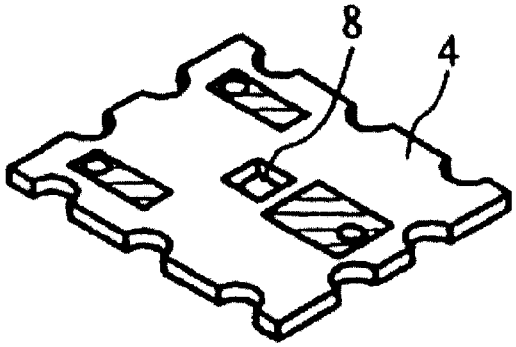
FIGS. 4A to 4C are views showing the construction of an isolator in accordance with a second embodiment of the present invention.
Figure 4B:
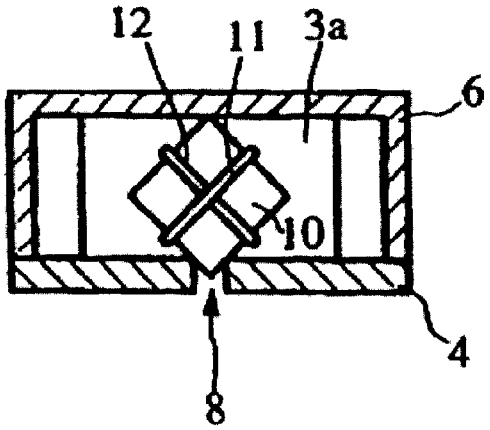
Figure 4C:
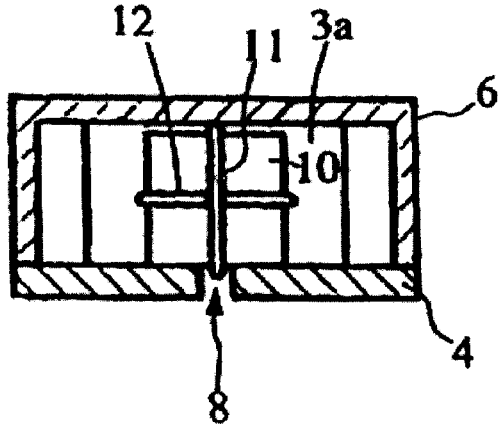

Next, the construction of an isolator in accordance with a second embodiment will be described with reference to FIGS. 4A to 4C. FIG. 4A is a perspective view showing a dielectric laminated substrate, and FIG. 4B is a vertical section showing the disposition relation between one magnet and a ferrite assembly of the isolator. FIG. 4C is a vertical section showing the isolator having an construction other than that of the one shown in FIG. 4B at the identical portion.

As shown in FIG. 4A, a hole 8 is formed at substantially central portion of a dielectric laminated substrate 4. When the ferrite assembly is disposed in the space formed by this dielectric laminated substrate 4 and a yoke 6, one corner portion of the ferrite 10 is engaged into the hole 8 of the dielectric laminated substrate 4, as shown in FIG. 4B. Thereby, the ferrite assembly is fixedly disposed between the dielectric laminated substrate 4 and the yoke 6 so that the ferrite assembly stands midway between two magnets 3*a* and 3*b* and so that the main surfaces of the ferrite 10 becomes parallel with those of the two magnets 3*a* and 3*b*.

In the example shown in FIG. 4C, the ferrite assembly is fixedly disposed between the dielectric laminated substrate 4 and the yoke 6 so that one central conductor 11 of the central conductors 11 and 12 wound around the ferrite 10 is engaged into a hole 8 provided in the dielectric laminated substrate 4. Since the central conductors 11 and 12 are thus wound around the ferrite 10, the one central conductor projects from the end face of the ferrite 10 by the portion of the sectional diameter of the central conductor. This arrangement eliminates the need for a useless space around the ferrite 10, and thereby allows the ferrite assembly having a determined size to be accommodated within a limited space.

Figure 5A:
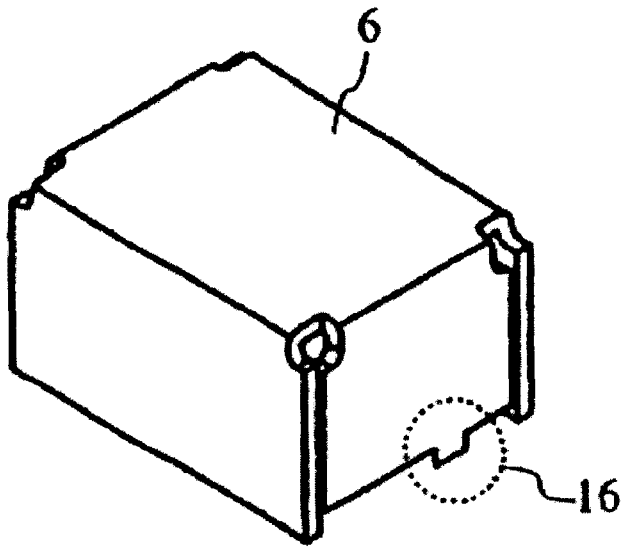
FIGS. 5A and 5B are views showing the construction of an isolator in accordance with a third embodiment of the present invention.
Figure 5B:
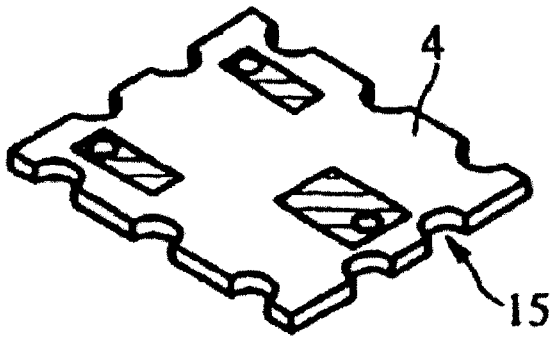

Next, the construction of an isolator in accordance with a third embodiment will be described with reference to FIGS. 5A and 5B. FIG. 5A is a perspective view showing the structure of a yoke 6, and the positional relationship between the yoke and 6 a dielectric laminated substrate 4, and FIG. 5B is a side view when the yoke 6 and the dielectric laminated substrate 4 are assembled.

Figure 5B:
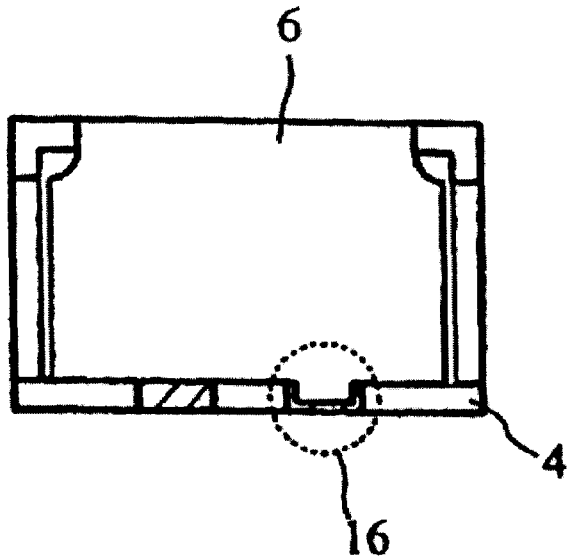

In FIG. 5, terminal electrodes in the end faces of the dielectric laminated substrate 4 are through hole electrodes. These through hole electrodes are formed in the end faces by forming through holes so as to extend over adjacent substrates before the dielectric laminated substrate 4 is cut off from a motherboard, and by dividing these through holes by lines passing therethrough.

The yoke 6 has projections 16 for engaging into the forming portion of the through hole electrodes 15 provided in the dielectric laminated substrate 4. The through hole electrodes 15 of the dielectric laminated substrate 4 is conductively connected to a ground electrode, and the projection 16 of the yoke 6 and the recess of the through hole electrode 15 are soldered together in a state of being engaged with each other, as shown in FIG. 5B, whereby a mechanical bonding therebetween and an electrical ground connection thereof are simultaneously achieved.

Figure 6:
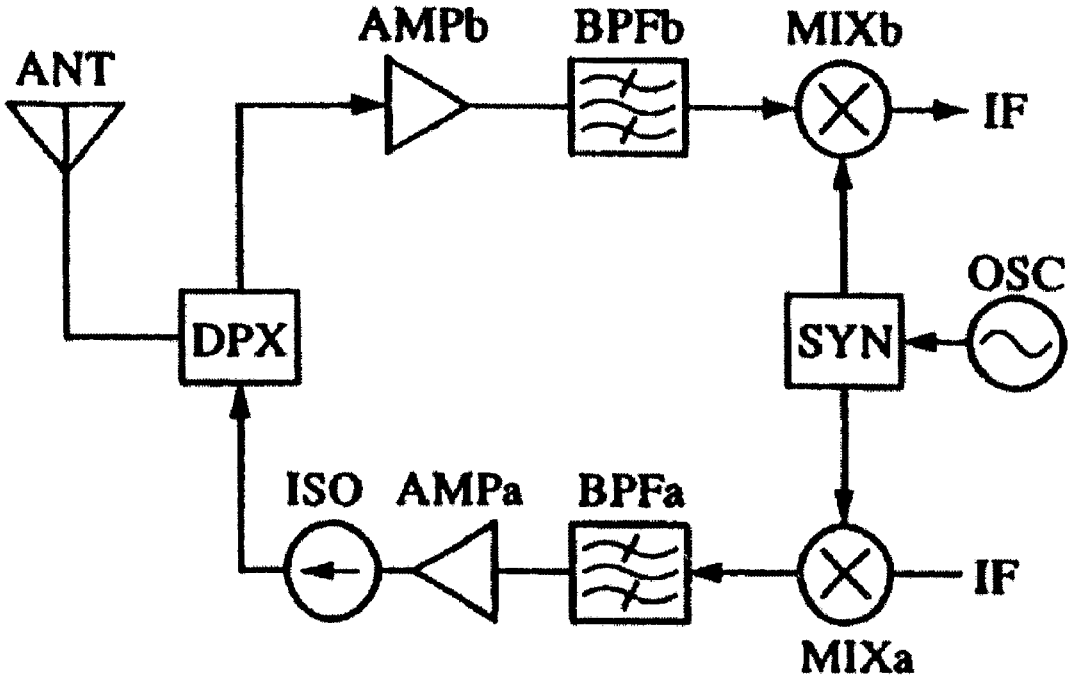
FIG. 6 is a block diagram showing the construction of a communication apparatus in accordance with a fourth embodiment of the present invention.

Next, the construction of a communication apparatus in accordance with a fourth embodiment will be described with reference to FIG. 6. In FIG. 6, reference character ANT denotes a transmitting/receiving antenna, DPX a duplexer. BPFa and BPFb each denote band pass filters, AMPa and AMPb amplifying circuits, and MIXa and MIXb mixers. Reference character OSC denotes an oscillator, SYN a frequency synthesizer, and ISO an isolator.

MIXa mixes the inputted IF signals and the signals outputted from SYN, BPFa passes only the transmission frequency band among the mixed output signals from MIXa, and AMPa power-amplifies these signals and transmits them from ANT via an isolator ISO and DPX. On the other hand, AMPb amplifies the received signals taken out from DPX. BPFb passes only the reception frequency band among the received signals outputted from AMPb. MIXb mixes the frequency signals outputted from SYN and the received signals, and outputs intermediate frequency signals IF.

For the isolator portion shown in FIG. 6, an isolator having the structure shown above is used.

By using such an isolator which has allowed miniaturization, thinning, an improvement in the reliability, and a cost reduction to be achieved, there is provided an communication apparatus such as a portable telephone which is low in the cost and high in the reliability, and in which an overall reduction in the thickness and the weight have been realized.

As is evident from the foregoing, in accordance with the present invention, the need to mount discrete chip-shaped capacitor elements and chip resistors onto a printed board, is eliminated. This allows mass-production at a low cost to be achieved, eliminates the complicatedness of the management of circuit elements, and improves the reliability due to a significant reduction in the number of connection portions, thereby enhancing the effects of overall size-reduction and cost-reduction.

Particularly in a two-port type nonreciprocal circuit device, incorporating numerous capacitors required for the matching circuit into the single dielectric laminated substrate, increases the mass-productivity, eliminates the complicatedness of the management of capacitor elements, and improves the reliability of the dielectric laminated substrate, thereby enhancing the effects of overall size-reduction and cost-reduction.

By forming, in the dielectric laminated substrate, a recess or a hole at which the ferrite portion of the ferrite assembly is engaged with the dielectric laminated substrate, the fixing of the ferrite assembly to within the nonreciprocal circuit device is facilitated, the need for special members for fixing is eliminated, and the overall height is reduced by the dimension of the ferrite portion engaged into the above-described recess or hole.

The ferrite assembly is formed by winding each of the central conductors around the ferrite, and the dielectric laminated substrate has therein a recess or a hole at which the central conductor portion of the ferrite assembly is engaged into the dielectric laminated substrate. Thereby, the fixing of the ferrite assembly to within the nonreciprocal circuit device is facilitated, and the overall height of the ferrite is reduced by the dimension of the central conductor portion engaged into the recess or hole.

The ferrite assembly, the magnets, and the yoke are arranged on the dielectric laminated substrate in this order from below upward, as well as through hole electrodes are provided in the side surfaces of the dielectric laminated substrate, and projections for engaging into the electrodes are provided on the yoke side. With this arrangement, the ground connection of the dielectric laminated substrate and yoke is facilitated, and the connection portions are prevented from projecting outside from the side surfaces of the dielectric laminated substrate. This enables the achievement of miniaturization.

Also, by soldering the each of projections of the yoke and one of the through hole electrodes together, electric and mechanical coupling can be simultaneously achieved.

Furthermore, by forming electrodes for connecting the central conductors with the dielectric laminated substrate, on the top surface of the dielectric laminated substrate, the central conductors of the ferrite assembly can be easily surface-mounted on the top surface of the dielectric laminated substrate.

Moreover, in the present invention, by forming electrodes for connecting the dielectric laminated substrate with outer circuits, on the bottom surface of the dielectric laminated substrate, these electrodes can be used as terminals just as it is when the nonreciprocal circuit device is surface-mounted onto the circuit board on which it is to be mounted.

Furthermore, in accordance with the present invention, by providing the above-described nonreciprocal circuit device in, for example, the output portion of the circuit for amplifying transmission signals, there is provided an communication apparatus such as a portable telephone which is low in the cost and high in the reliability, and in which an overall reduction in the thickness and the weight has been realized.

While the present invention has been described with reference to what are at present considered to be the preferred embodiments, it is to be understood that various changes and modifications may be made thereto without departing from the invention in its broader aspects and therefore, it is intended that the appended claims cover all such changes and modifications as fall within the true spirit and scope of the invention.

What is claimed is:

1. A nonreciprocal circuit device, comprising:

a ferrite assembly constituted by combining a ferrite and first and second central conductors which are arranged so as to mutually intersect in a state of being electrically insulated from each other;

a magnet applying an magnetostatic field to said ferrite assembly;

a yoke; and circuit elements which are connected to said first and second central conductors, and which constitute a matching circuit, wherein said circuit elements are constituted of a dielectric body of a dielectric laminated substrate on which said ferrite assembly is mounted, and electrodes provided on predetermined layers of the dielectric laminated substrate.

2. The nonreciprocal circuit device according to claim 1, wherein said circuit elements provided in said dielectric laminated substrate include a plurality of capacitors.

3. The nonreciprocal circuit device according to claim 1, wherein said dielectric laminated substrate has a recess or a hole at which the ferrite portion of said ferrite assembly is engaged with said dielectric laminated substrate.

4. The nonreciprocal circuit device according to claim 1, wherein:

said ferrite assembly is formed by winding each of said central conductors around said ferrite; and said dielectric laminated substrate has a recess or a hole at which the central conductor portion of said ferrite assembly is engaged into said dielectric laminated substrate.

5. The nonreciprocal circuit device according to claim 1, wherein:

said ferrite assembly, said magnet, and said yoke are arranged on said dielectric laminated substrate;

through hole electrodes are provided in the side surfaces of said dielectric laminated substrate; and projections provided on said yoke are engaged into said through hole electrodes.

6. The nonreciprocal circuit device according to claim 5, wherein said projections of said yoke and said through hole electrode are soldered together.

7. The nonreciprocal circuit device according to claim 1, wherein electrodes to be connected to the central conductors are provided on the top surface of said dielectric laminated substrate.

8. The nonreciprocal circuit device according to claim 1, wherein electrodes to be connected to external circuits are provided on the bottom surface of said dielectric laminated substrate.

9. A communication apparatus including the nonreciprocal circuit device according to claim 1.

* * * * *